United States Patent [19]

Matejec et al.

[11] Patent Number: 4,464,464

[45] Date of Patent: Aug. 7, 1984

[54] COLOR PHOTOGRAPHIC RECORDING MATERIAL

[75] Inventors: Reinhart Matejec; Fritz Nittel; Johannes Sobel, all of Leverkusen, Fed. Rep. of Germany

[73] Assignee: Agfa-Gevaert Aktiengesellschaft, Leverkusen, Fed. Rep. of Germany

[21] Appl. No.: 401,837

[22] Filed: Jul. 26, 1982

[30] Foreign Application Priority Data

Jul. 30, 1981 [DE] Fed. Rep. of Germany ..... 3130079

[51] Int. Cl.[3] ..... G03C 7/26

[52] U.S. Cl. ..... 430/546; 430/496; 430/548

[58] Field of Search ..... 430/546, 377, 548, 496

[56] References Cited

U.S. PATENT DOCUMENTS

| | | | |
|---|---|---|---|
| 3,689,271 | 9/1972 | Nittel et al. | 430/512 |
| 3,764,336 | 10/1973 | Nittel et al. | 430/546 |
| 3,765,897 | 10/1973 | Nittel | 430/546 |
| 3,779,765 | 12/1973 | McCrossen et al. | 430/546 |
| 3,912,517 | 10/1975 | Van Poucke et al. | 430/546 |
| 3,920,456 | 11/1975 | Nittel | 96/87 |
| 3,948,663 | 4/1976 | Shiba et al. | 430/546 |
| 4,297,438 | 10/1981 | Haseler et al. | 430/377 |
| 4,368,259 | 1/1983 | Nittel | 430/546 |

*Primary Examiner*—J. Travis Brown

*Attorney, Agent, or Firm*—Connolly and Hutz

[57] ABSTRACT

The color yield and color granularity of color photographic recording materials is improved by using compounds of the general formula I as the sole or as additional oil formers in coupler-containing internal layers. The effect is particularly clear in layers having the small amount of gelatine.

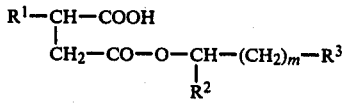

I wherein:

$R^1$ is an aliphatic group having at least 8 carbon atoms, $R^2$ is hydrogen or alkyl, $R^3$ is a heterocyclic group or $-(X)_n-R^4$, $R^4$ is aryl, X is —O—, —NH—, $-NCH_3-$, or —CH=CH—, m is 0, 1 or 2, and n is 0 or 1.

5 Claims, No Drawings

COLOR PHOTOGRAPHIC RECORDING MATERIAL

This invention relates to a color photographic recording material comprising at least one silver halide emulsion layer and color couplers incorporated therein, in which material the color yield is increased and the color granularity is simultaneously reduced by specific additives.

High color yields during chromogenic development are generally very desirable. The term "color yield" is understood to mean the ratio of maximum color density to silver halide application (specified in g of $AgNO_3$ per square meter). Where there are higher color yields, the necessary maximum densities are achieved with small silver applications, which has an advantageous effect on sharpness and sensitivity.

Methods of increasing the color yield (i.e., achieved as high color densities as possible with the smallest possible silver application) are known to those skilled in the art. Thus, in principle, higher color yields are achieved by using a high ratio of couplers to silver halide, in order to couple the developer oxidation product resulting from color development as completely as possible to the dye. Color couplers which have a fast coupling rate act in the same manner. However, both methods have the disadvantage that, when the color yield increases, the color granularity usually also greatly increases.

It is known that, compared to large silver halide grains, smaller grains produce higher color yields and lower color granularities. However, when smaller silver halide grains are used, the photographic sensitivity is also lower.

U.S. Pat. No. 4,207,393 describes substances which enable the color yield to be increased. However, the efficiency of these substances is comparatively low. Moreover, they do not reduce the color granularity.

An object of the present invention is to provide a color photographic recording material having an increased color yield and a reduced color granularity.

The present invention provides a color photographic recording material comprising at least one silver halide emulsion layer and, in association therewith, a color coupler for chromogenic development, characterized in that a compound of the following general formula I is contained in at least one coupler-containing internal layer:

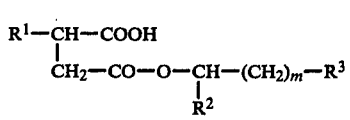

I wherein:

$R^1$ represents a straight-chain or branched, saturated or unsaturated aliphatic group having at least 8 and preferably from 12 to 18 carbon atoms, $R^2$ represents hydrogen or alkyl, for example, $—CH_3$ or $—C_2H_5$, $R^3$ represents a heterocyclic group linked via a ring C-atom or via a ring N-atom, e.g. furyl, thienyl or morpholino, or a group of the formula $—(X)_n—R^4$, $R^4$ represents an aryl group, X represents —O—, —NH—, $—NCH_3—$ or —CH=CH—, m represents 0, 1 or 2, and n represents 0 or 1.

The aryl group represented by $R^4$ is, for example, a phenyl group or a naphthyl group. These groups may be unsubstituted or may have further substituents, for example, halogen, alkyl, alkoxy, acylamino, nitro, alkyl sulfonyl, aryl sulfonyl and cyano. Moreover, the aryl groups represented by $R^4$ may carry another group of the following formula:

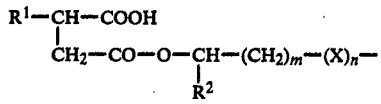

wherein $R^1$, $R^2$, X, m and n are as defined above, or a substituent carrying one such group.

The following structural features presumably contribute to the effect described (increase in the color yield and decrease in the color granularity), which features are jointly present in the compounds according to the present invention.

(a) long chains for micell formation with the binder (gelatine), (b) free carboxyl groups for saponification or for a certain solubilizing tendency in the alkaline range, and (c) ester groups having neighbouring cyclic radicals which possibly exert solubilising effects on the image dye, the leuko dye or the color coupler.

Examples of suitable compounds according to the present invention are specified in the following (Table 1):

TABLE 1

| Compound | $R^1$ | $R^2$ | m | $R^3$ |
|---|---|---|---|---|
| 1 | i-$C_8H_{15}$ | H | 0 | 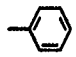 |
| 2 | i-$C_{12}H_{23}$ | H | 0 | 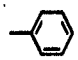 |
| 3 | i-$C_{18}H_{35}$ | H | 0 | 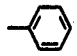 |
| 4 | i-$C_{18}H_{35}$ | H | 1 | 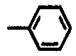 |
| 5 | i-$C_{18}H_{35}$ | $CH_3$ | 1 | 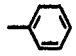 |
| 6 | i-$C_{18}H_{35}$ | $CH_3$ | 1 | 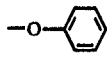 |
| 7 | i-$C_{18}H_{35}$ | H | 1 | 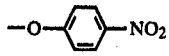 |
| 8 | i-$C_{18}H_{35}$ | H | 0 | 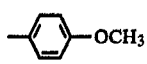 |
| 9 | i-$C_{18}H_{35}$ | H | 1 | 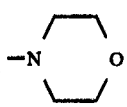 |

TABLE 1-continued

| Compound | $R^1$ | $R^2$ | m | $R^3$ |
|---|---|---|---|---|
| 10 | i-$C_{18}H_{35}$ | H | 1 | 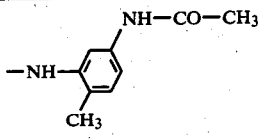 |
| 11 | i-$C_{18}H_{35}$ | H | 1 | 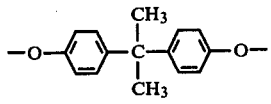 |
| 12 | i-$C_{18}H_{35}$ | H | 1 | 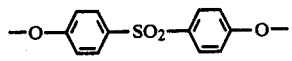 |
| 13 | i-$C_{18}H_{35}$ | H | 1 | 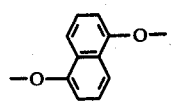 |
| 14 | i-$C_{18}H_{35}$ | H | 0 | 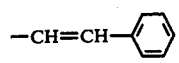 |
| 15 | i-$C_{18}H_{35}$ | H | 0 | 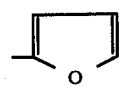 |
| 16 | $C_{12}H_{25}$ | H | 0 | 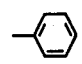 |
| 17 | $C_{15}H_{29}$ | $CH_3$ | 1 | 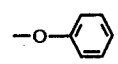 |
| 18 | $C_{15}H_{31}$ | H | 0 | 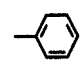 |
| 19 | $C_{16}H_{31}$ | H | 0 | 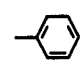 |
| 20 | $C_{16}H_{33}$ | H | 0 | 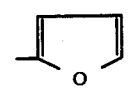 |
| 21 | $C_{18}H_{37}$ | H | 0 | 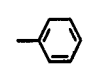 |

The radical $R^3$ specified in compounds 11, 12 and 13 is a symmetrical divalent radical, to which are bound two succinic acid monoester radicals, with the specified meanings of $R^1$, $R^2$ and m in each case.

The long-chain radicals which occur in the specified compounds 1 to 21 are not clearly determined with respect to the degree of branching and, as far as unsaturated radicals are concerned, with respect to the position of the double bond. They are presumably isomeric mixtures.

The compounds used according to the present invention are very readily prepared. The starting materials for their preparation are long-chain-substituted succinic acid anhydrides which are reacted with suitable hydroxy copounds in a known manner. During this reaction, the succinic acid anhydride ring is opened with the formation of a carboxyl group and an ester group. Related products are produced in which the long-chain radical is in the $\alpha$-position to the carboxyl group, and such products in which this radical is in the $\beta$-position to the carboxyl group. For reasons of simplicity, only one form is illustrated in the general formula I, which form represents a simplified representation of both forms in this respect.

Method for the preparation of compound 3

3,520 g of octadecenyl succinic acid anhydride, 1,080 g of benzyl alcohol and 20 g of DABCO (1,4-diazabicyclo[2,2,2]octane) were heated for 3 hours at 120° C. in a 10 liter four-necked flask, equipped with a stirrer, a thermometer and a reflux cooler. 4,600 g of diethyl carbonate were added with stirring to the highly-viscous reaction mixture which was cooled to 50° C., a 50% solution in diethyl carbonate being obtained.

The other compounds may be prepared analogously.

The compounds of the general formula I may advantageously be used as oil formers in the preparation of color coupler emulsions, in which case they may be used either instead of or in admixture with conventional hydrophobic oil formers, such as tricresyl phosphate or dibutyl phthalate, for example, according to U.S. Pat. No. 2,322,027 or with more or less hydrophilic oil formers, for example, according to German Offenlegungsschrift Nos. 1,772,192; 2,042,659 and 2,049,689. Several compounds of the general formula I may also be used alongside each other or in admixture with each other. However, it is also possible to emulsify these compounds in the absence of color couplers and to mix emulsions or solutions containing color couplers with the emulsions which are free from color couplers and are obtained by this process. The conventional method is used for the preparation of the emulsions, in which method the substances to be emulsified, for example, the color couplers and optionally other additives, such as white couplers, UV stabilizers and antioxidants, are emulsified into the casting solution of the photographic layer which contains in particular the binder and optionally other ingredients, together with the compounds to be used according to the present invention, dissolved in a water-immiscible or in any only slightly water-miscible organic solvent and with the assistance of an emulsifying device, in a ratio which corresponds to the required concentration of the substance to be worked in.

However, it is also possible to initially prepare an emulsion and optionally store it temporarily, this emulsion not being identical to the actual casting solution, but only being mixed with this solution at a later stage. Higher speed stirrers, so-called mixing sirens, "Ultraturrax" devices and ultrasonic devices, for example, are suitable as emulsifying devices for this purpose. The compounds of the general formula I are generally used in a quantity of from 0.05 to 5.0 parts, based on 1 part of color coupler. They are preferably used in quantities of from 0.1 to 1.0 parts, per part of colour coupler (parts by weight).

The color photographic recording material of the present invention contains at least one silver halide emulsion layer and at least one color coupler associated with this emulsion layer. The term "associated" is understood to mean that the spatial arrangement of silver halide emulsion layer and color coupler is such that an interaction is possible between them during chromogenic development, which interaction allows an imagewise conformity between the formed silver image and the imagewise distribution of the dye produced by chromogenic development. For this purpose, the color coupler does not necessarily have to be contained in the light-sensitive silver halide emulsion layer. It may also be present in a light-insensitive binder layer which is next to the silver halide emulsion layer. The color photographic recording material according to the present invention usually contains at least three silver halide emulsion layers of differing spectral sensitivity and color couplers associated in each case, the term "associated" also covering the relation between the spectral sensitivity of the silver halide emulsion layer and the color of the dye produced from the associated color coupler during chromogenic development. The color of the image dye is generally complementary to the color of the light which is recorded in the associated silver halide emulsion layer. In specific cases, the color photographic recording material may also contain several silver halide emulsion layers of the same spectral sensitivity and optionally of a different overall sensitivity ("speed"), in which case, several silver halide emulsion layers having the respectively associated color couplers may again be combined into layer units, either being arranged according to their spectral sensitivity or according to their overall sensitivity. Layers or layer units of different spectral sensitivity are usually separated from each other by light-insensitive intermediate layers, in order effectively to prevent undesirable diffusion of developer oxidation products into non (spectrally) associated layers containing color couplers. The intermediate layers may be pure binder layers or such layers which contain other additives, for example, compounds which are capable of reacting with diffusing developer-oxidation products, filter dyes, hardening agents, embedded developers, UV absorbers or (non-light-sensitive) micrate emulsions.

The color photographic recording material according to the present invention contains a compound of the general formula I in at least one coupler-containing internal layer, i.e. in a layer which is covered by at least one other layer. This internal layer may be any one or even several of the light-sensitive silver halide emulsion layers or it may be one or more of the light-insensitive layers containing color couplers which are next to a silver halide emulsion layer.

The color couplers are generally such couplers which may be worked into casting solutions with the aid of oil formers. They are usually couplers which are soluble in organic solvents, particularly in oil formers (so-called hydrophobic couplers). However, hydrophilic couplers may also be used which, according to one process, for example as described in German Offenlegungsschrift No. 30 02 201, may be worked in together with oil formers. The couplers are 2-, 4- or 6-equivalent color couplers (Research Disclosure 19 536—July 1980). They are colorless or colored (mask couplers). Other couplers may also be used, for example, white couplers or DIR couplers.

By means of the compounds of the general formula I, not only is the color yield effectively improved, but at the same time, the color granularity is also considerably reduced. The increase in the color yield and the decrease in the color granularity is particularly pronounced when the compounds according to the present invention are used in layers which are comparatively low in gelatine. The term "layers which are comparatively low in gelatine" is understood to mean layers which (a) contain less than 0.6 g, preferably less than 0.5 g, of gelatine per 1 g of $AgNO_3$ present as silver halide, or (b) contain less than 0.8 g, preferably less than 0.6 g, of gelatine per 1 g of colour coupler in the absence of silver halide, but in the presence of colour couplers.

The color photographic recording material according to the present invention is equally suitable for the production of color negatives and for the reversal process.

EXAMPLE 1

Emulsions containing color couplers

1.1 Preparation of the dispersion

Dispersions containing color couplers were prepared using the compounds according to the present invention, as described in the following using the example of compound 3. A compound of the following formula was used as the color coupler:

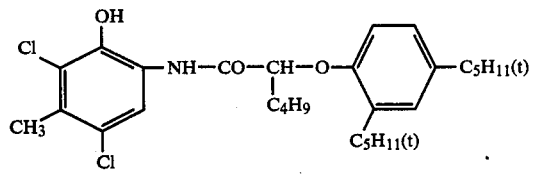

A solution of 5 g of compound 3 and 1.33 g of dodecylbenzene sulfonic acid sodium salt (75%) in 15 g of ethyl acetate was emulsified into 400 ml of a 5% aqueous gelatine solution (50° C.) (first stage). After the addition, the mixture was then stirred for 3 minutes and a coupler solution of 100 g of color coupler and 30 g of compound 3 in 200 g of ethyl acetate was then emulsified in (second stage). Ethyl acetate was then substantially evaporated.

The quantity of the oil former emulsified in together with the color coupler (second stage) is from 10 to 15%, based on the quantity of the coupler, and preferably from 20 to 70%.

1.2 Preparation of the casting solution 1 part of a red-sensitized silver bromo-iodide emulsion containing 6 mol % of iodide, the quantity of silver halide being equivalent to 200 g of $AgNO_3$, and 30 g of gelatine per kg, was mixed with 1 part of the dispersion prepared according to 1.1 and with 2 parts of water (parts by weight).

1.3 Production of a light-sensitive material and processing

The casting solution prepared according to 1.2. was cast onto a substrate (silver application: 2 g of $AgNO_3$ per square meter), hardened, exposed behind a step wedge and processed according to a color negative process which is described in "The British Journal of Photography", 1974, pages 597 and 598. The following Table 2 gives the color yields determined at $D_{max}$ (measured behind a red filter) and the color granularity values $\sigma_D$ measured for the densities D=0.5, D=1.0 and D=1.5. Reference is made to T. H. James, The Theory of the Photographic Process, 4th edition, Macmillan Publ. Co., In., New York/London, 1977, P. 618-621, with respect to determining the color granularity.

TABLE 2

| Oil former (compound) | Color yield [$D_{max}$/g $AgNO_3$ per $m^2$] | Color granularity $D^{\Sigma}.10^2$ | | |
|---|---|---|---|---|
| | | D = 0.5 | D = 1.0 | D = 1.5 |
| None | 1.12 | 4.2 | 5.2 | 6.4 |
| Tricresyl phosphate | 1.43 | 4.1 | 5.3 | 6.2 |
| 1 | 1.63 | 3.9 | 5.0 | 5.9 |
| 2 | 1.81 | 2.4 | 4.1 | 4.9 |
| 3 | 1.94 | 2.2 | 3.8 | 4.7 |
| 4 | 1.76 | 2.9 | 4.3 | 5.0 |
| 5 | 1.62 | 3.2 | 4.6 | 5.2 |
| 6 | 1.89 | 2.9 | 4.5 | 5.3 |
| 7 | 1.85 | 2.8 | 4.4 | 5.2 |
| 8 | 1.84 | 2.8 | 4.5 | 5.1 |
| 9 | 1.54 | 3.9 | 5.2 | 5.9 |
| 10 | 1.58 | 3.8 | 5.0 | 6.0 |
| 11 | 1.85 | 3.3 | 4.8 | 5.2 |
| 12 | 1.82 | 3.4 | 4.7 | 5.5 |
| 13 | 1.86 | 3.2 | 4.8 | 5.3 |
| 14 | 1.72 | 3.6 | 4.6 | 5.5 |
| 15 | 1.80 | 3.2 | 4.7 | 5.2 |

EXAMPLE 2

Concentrated dispersions free from color couplers for admixture

2.1 Preparation of the dispersions

The following description, using the example of compound 3, states how concentrated coupler-free dispersions for admixture were prepared from the compounds according to the present invention.

0.5 kg of a 10% aqueous solution of di-sec.-butylnaphthalene sulfonic acid sodium salt were added to 10 liters of a 10% gelatine solution (50° C.) and a solution of 4 kg of compound 3 in 4 kg of diethyl carbonate was then emulsified therein using a high-speed mixing siren. After the auxiliary solvent was evaporated, a highly concentrated dispersion for admixture was obtained containing 270 g of compound 3 per kg of emulsion, which may be added to an emulsion in addition to the color coupler emulsion.

2.2 Preparation of the casting solution 1 part of a green-sensitized silver bromo-iodide emulsion containing 6 mol % of iodide, the quantity of silver halide being equivalent to 200 g of $AgNO_3$, and 30 g of gelatine per kg, was mixed with 0.5 parts of an emulsion which, per kg, contained 185 g of a coupler of the following formula:

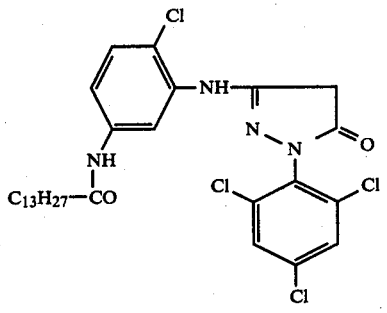

as well as 55 g of dibutyl phthalate and 37 g of gelatine. 0.1 parts of the dispersion for admixture described under 2.1 and 0.4 parts of water were also added (parts by weight).

2.3 Production of a light-sensitive material and processing

The casting solution prepared according to 2.2. was cast onto a substrate with a silver application of 2 g of $AgNO_3$ per square meter, hardened, exposed behind a step wedge and subjected to the following color-reversal processing:

| | |
|---|---|
| Black-and-white development: | |
| 6 minutes at 30° C. in a developer consisting of the following: | |
| Distilled water | 300 ml |
| Ethylenediaminetetraacetic acid | 2.0 g |
| 1-phenyl-3-pyrazolidone | 0.3 g |
| Sodium sulfite (anhydrous) | 50.0 g |
| Hydroquinone | 6.0 g |
| Sodium carbonate (anhydrous) | 35.0 g |
| Potassium rhodanide | 2.5 g |
| Potassium bromide | 2.0 g |
| Potassium iodide | 0.015 g |
| made up with water to 1000 ml | |
| pH = 10 | |
| Stop bath: | |
| 5 minutes in a solution of the following: | |
| Distilled water | 300 ml |
| Sodium acetate (crystallized) | 30 g |
| Acetic acid | 5 ml |
| made up with water to 1000 ml | |
| pH = 5 | |

Intermediate washing: 10 min.
Diffuse reversal exposure: 2 min.

| Color development: 6 min. in a color developer consisting of the following: | |
|---|---|
| Distilled water | 300 ml |
| Nitrilotriacetic acid | 2 g |
| Trisodium phosphate | 20 g |
| 4-amino-3-methyl-N—ethyl-N—(β-hydroxyethyl)-aniline | 6 g |
| Potassium bromide | 2.0 g |
| Hydroxylamine | 1.2 g |
| Sodium sulfite | 5.0 g |
| made up with water to 1000 ml, pH = 11.7 | |

Intermediate washing: 10 min.

| Bleaching bath: 5 min. in a bleaching bath consisting of the following: | |
|---|---|
| Potassium ferricyanide | 8 g |
| Potassium bromide | 20 g |
| Disodium phosphate | 12 g |
| made up with water to 100 ml and adjusted to pH 5.2 using acetic acid. | |

Intermediate washing: 5 min

| Fixing: 5 min. in a fixing bath consisting of the following: | |
|---|---|
| Ammonium thiosulfate | 150 g |
| Sodium sulfite (anhydrous) | 10 g |
| Sodium hexamethaphosphate | 2 g |
| made up with water to 1000 ml, pH = 7. | |

Final washing: 5 min.

TABLE 3

| Oil former in the admixed emulsion | Color Yield [$D_{max}$/g $AgNO_3$ per $m^2$] | Color granularity $p^{\Sigma}.10^2$ | | |
|---|---|---|---|---|
| | | D = 0.5 | D = 1.0 | D = 1.5 |
| No admixed emulsion | 1.52 | 4.5 | 6.0 | 6.8 |
| 1 | 1.75 | 4.0 | 5.3 | 6.4 |
| 2 | 1.90 | 2.3 | 4.2 | 5.2 |
| 3 | 2.05 | 2.3 | 4.0 | 5.0 |
| 4 | 1.81 | 3.5 | 4.5 | 5.6 |
| 5 | 1.69 | 3.7 | 4.8 | 5.9 |
| 6 | 1.98 | 3.3 | 4.6 | 5.7 |
| 7 | 1.98 | 3.0 | 5.0 | 5.6 |
| 8 | 1.95 | 3.4 | 4.8 | 5.8 |
| 9 | 1.58 | 4.4 | 5.8 | 6.2 |
| 10 | 1.64 | 4.5 | 5.9 | 6.5 |
| 11 | 1.96 | 3.9 | 5.4 | 6.2 |
| 12 | 1.95 | 4.0 | 5.3 | 6.2 |
| 13 | 1.95 | 4.1 | 5.5 | 6.1 |
| 14 | 1.88 | 4.6 | 5.9 | 6.7 |
| 15 | 1.90 | 4.4 | 5.8 | 6.5 |

We claim:

1. A color photographic recording material of increased color yield and reduced color granularity comprising at least one silver halide emulsion layer,
a color coupler for chromogenic development associated with said silver halide layer,
and at least one internal layer comprising one or more hydrophobic color couplers and an oil former compound with the proviso that all color couplers in said internal layer are hydrophobic,
said oil former compound being of the following general formula

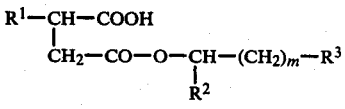

wherein
$R^1$ represents aliphatic group having at least 8 carbon atoms,
$R^2$ represents hydrogen or alkyl,
$R^3$ represents a heterocyclic group linked via a ring C-atom or via a ring N-atom, or a group of the formula $-(X)_n-R^4$,
$R^4$ represents aryl,
X represents —O—, —NH—, $-NCH_3-$ or —CH=CH—,
m represents 0, 1 or 2 and
n represents 0 or 1.

2. A recording material as claimed in claim 1 wherein the binder layer additionally contains at least one (other) oil former for the hydrophobic color coupler.

3. A recording material as claimed in claim 2, wherein the other oil former does not correspond to the general formula I.

4. A recording material as claimed in claim 1 wherein the compound of the general formula I is contained in a silver halide emulsion layer which contains less than 0.6 g of gelatine, based on the quantity of silver halide corresponding to 1 g of $AgNO_3$.

5. A recording material as claimed in claim 1 wherein the compound of the general formula I is contained in a binder layer free from silver halide which contains less than 0.8 g of gelatine, based on 1 g of the color coupler contained therein.

* * * * *